United States Patent [19]

Zambolin

[11] Patent Number: 4,550,649

[45] Date of Patent: Nov. 5, 1985

[54] PROCESS AND APPARATUS FOR REDUCING THE TEMPERATURE GRADIENT IN BUILDINGS

[76] Inventor: Marco Zambolin, via Gassendi 13, 20155 Milan, Italy

[21] Appl. No.: 398,629

[22] Filed: Jul. 15, 1982

[30] Foreign Application Priority Data

Jul. 31, 1982 [IT] Italy ..... 23283 A/81

[51] Int. Cl.[4] ..... F24F 9/00

[52] U.S. Cl. ..... 98/39.1; 98/40.10

[58] Field of Search ..... 98/31, 33 R, 35, 39, 98/40 R, 40 D, 41 R; 137/601

[56] References Cited

U.S. PATENT DOCUMENTS

| | | | |
|---|---|---|---|
| 2,767,961 | 10/1956 | Frankland | 98/33 R X |
| 3,011,518 | 12/1961 | Day et al. | 137/601 |
| 3,252,400 | 5/1966 | Madl, Jr. | 98/33 R X |
| 3,363,532 | 1/1968 | Horneff | 98/40 D X |
| 4,239,020 | 12/1980 | Kiyokawa et al. | 98/40 D X |

FOREIGN PATENT DOCUMENTS

| | | | |
|---|---|---|---|
| 131637 | 10/1980 | Japan | 98/33 R |
| 1187308 | 4/1970 | United Kingdom | 98/29 |
| 1226212 | 3/1971 | United Kingdom | 98/33 R |

*Primary Examiner*—Harold Joyce

*Attorney, Agent, or Firm*—McGlew and Tuttle

[57] ABSTRACT

The invention relates to an air-conditioning process, intended particularly for industrial buildings, by means of which air is admitted, at outdoor temperature, into the zone below the roofing, in order to decrease the thermal gradient between the upper and the lower part of the building, and thus diminish the dissipations of heat through the roof. A double ceiling made of porous, preferably translucent, material permits the uniform distribution, over the whole surface of the building, of the air flux shifting from the upper over-pressured area to the lower area.

7 Claims, 4 Drawing Figures

PROCESS AND APPARATUS FOR REDUCING THE TEMPERATURE GRADIENT IN BUILDINGS

Figure 2:
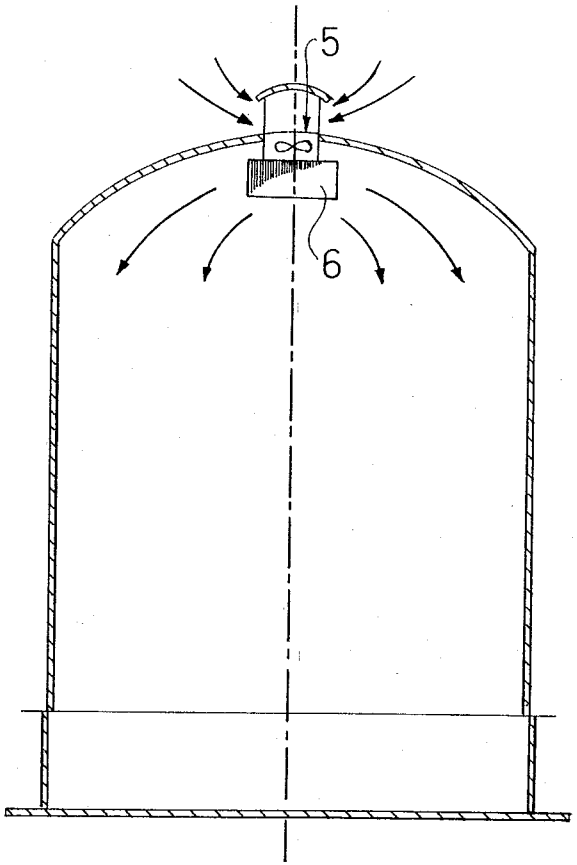

The present invention provides for an air-conditioning process, particularly for industrial buildings, allowing the diminishing remarkably of the thermal dissipations occurring in buildings, especially near the roof. The invention relates as well to plants for putting the process into practice. As it is well-known, the heating of premises is very expensive and the problem of reducing the relevant costs by means of suitable measures is becoming a more and more urgent matter.

Despite the fact that modern technology allows the use of materials having an ever-increasing degree of insulation, thermal dissipations continue to be excessively high. In particular, very high buildings are those especially affected by dissipation phenomena, due to a concurrence of unfavourable causes.

In most all cases it is the lower part of the building that is to be heated; on the other hand, in order to keep this part at a proper temperature, it is necessary to heat the whole of the building, and since heat, due to a known physical effect, tends to go upwards, the air temperature in the upper zones of the buildings is higher than that of the working ones.

Furthermore, the roofing is the least thermally insulated area in industrial buildings (both for technical and economic reasons), and it is in relation to this zone that the greatest difference between outdoor and indoor temperatures occurs.

It ensues that the maximum dissipations occur in that part of a building where heating is not a major exigency. Moreover, the difference in the temperature of the upper and lower part of the building causes hot air to escape through the fissures and holes existing in the upper part of the building, due to the so-called "draught effect".

This determines by reaction the filtration of a certain amount of cold air exactly in correspondence with the lower part of the building, wherein heating is most important.

In order to avoid the inconveniences mentioned above, the present invention provides for a process for the air-conditioning of buildings (industrial sheds in particular), according to which a certain amount of air is let in from outside in correspondence with the upper part of the shed, so as to produce a laminar flow acting as a thermally downwardly flowing fluid barrier against dissipations of heat due to conduction and radiation through the building roof and walls.

The process consists substantially in allowing a certain amount of over-pressured air to enter the upper part of the building, and then to evenly spread close to the roof and walls, so that the inner hot air does not come into contact with said roof and walls and no loss of heat occurs.

The admission of air such as the one described above reduces the filtration of air from outside in the lower part of the building, permitting the recovery of the heat hovering in strata in the upper part, and the utilization of the same to heat the air that was let in and that is heading downwards.

Basically, the process consists in letting in a certain amount of air from outside i.e. external ambient or cooler air, relation to and adjacent the roof, so as to make a barrier preventing the inner hot air from touching the roof itself and causing dissipations of heat.

The air introduced into the room makes its way downwards, absorbing heat from the upper hot air layers, until it reaches the lower zone at the desired temperature.

To prevent the air introduced in the room from heading downwards following localized lines of flux, there is provision for the utilization of a porous barrier allowing an even distribution of the flux all over the surface of the building.

FIGS. 1 to 4 of the accompanying drawing schematically show respective constructions involving four correspondingly different ways of putting the process according to the invention into practice.

Figure 1:
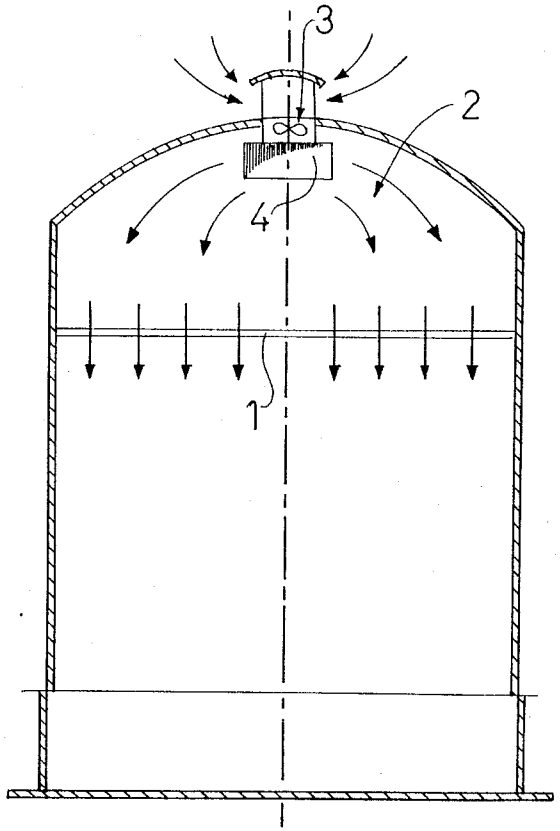
Figure 4:
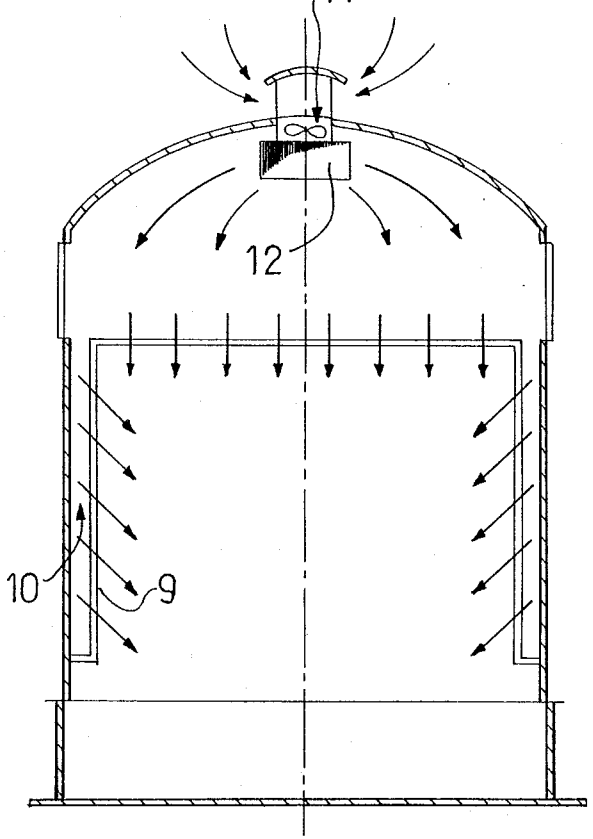

FIG. 1 schematically shows the section of a building divided in two by a double ceiling 1 consisting of a porous, preferably translucent barrier, which determines, below the roof, a zone 2 where, through a duct 3 and a distributing passage 4, there is admitted from outside an amount of air enough to keep said zone over-pressured or at a higher defferential pressure as compared to the air pressure of the lower zone; by "porous" is meant a barrier apt to cause loss of head.

Such a pressure spreads uniformly all over the surface of barrier 1 and, as a consequence thereof, the flux of air passes through the double ceiling and heads downwards. The air absorbs the heat hovering in the room, and reaches the lower zone at the desired temperature.

By this system, therefore, the thermal insulation of the roofing is achieved, in that the higher pressure of zone 2 prevents the heated air present in the room from going up and touching the roof itself.

By the provision for the over-pressured air present in the room it is then possible to avoid filtrations of cold air in correspondence with the lower part of the premises, wherein intake openings are usually provided.

The double ceiling 1 is advantageously made of translucent material, with a view to allowing the light to pass through, in the case of sheds with overhead lighting.

FIG. 2 schematically shows the section of a building insulated by the system according to the invention, in the case wherein the use of The porous barrier is not opportune or possible.

If this is the case, the outdoor air can be let in—e.g. by means of a fan or other known systems—always through a duct 5 and a passage 6, although suitable deflectors must be there, in order to make the air touch the whole inner surface of the roofing.

In this way the air tends to adhere tangentially to the surface, according to the Coanda principle, and a real cold air cushion is interposed between the inside and the roof.

In this case too the air cushion prevents heat from reaching the roof and escaping through it.

Figure 3:
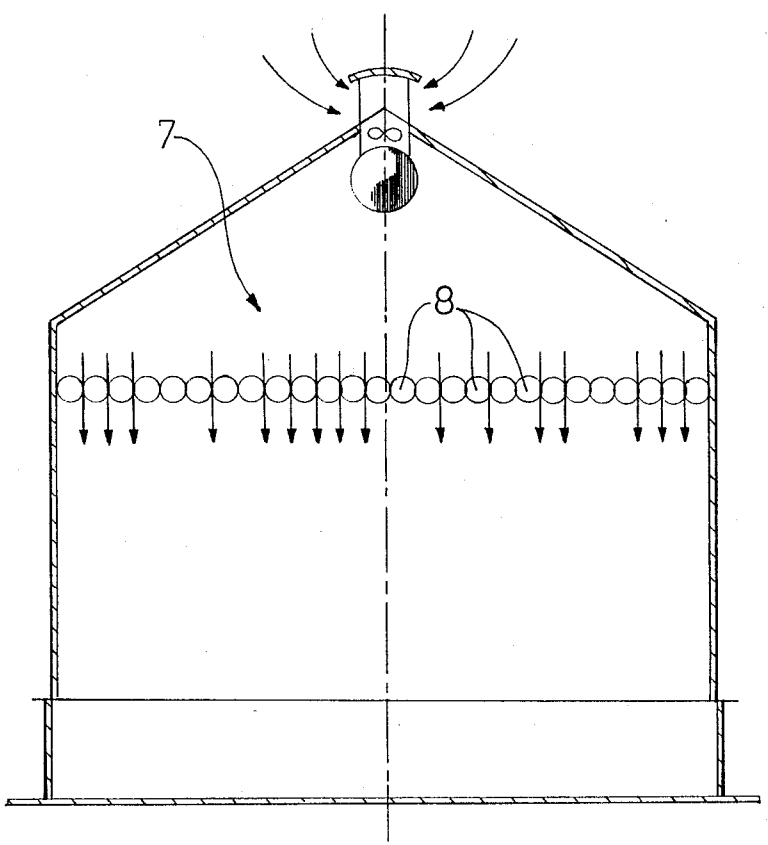

In FIG. 3 there is schematically shown a building, for instance a glasshouse or the like, wherein the double ceiling 7 is built by means of a number of inflatable tubular elements 8, preferably made of transparent material such as, e.g., polyethylene. When there is a considerable loss of heat also through the walls, for instance in the case of glass surfaces of vast sizes, it is possible to apply the porous barrier, e.g. as a continuation thereof, even to the walls (as illustrated, also schematically, in FIG. 4). Here a hollow space 10 is formed in correspondence with the walls by the porous translucent barrier 9; in said space properly spreads the air which had been previously admitted in the upper part always through a duct 11 and a distributing passage 12.

As the amount of heat which gets lost through one wall is proportional to the difference between the outdoor and the indoor temperature, the process according to the invention provides for the admission of a certain amount of air in the upper part of an industrial building, so as to form in correspondence with the inner surface of the roof and walls, an air cushion preventing heat from getting in touch with said roof and walls.

The air is spread so as to properly insulate the dissipative surfaces, and recover the heat hovering in strata in the upper part of the room by exploiting it to heat the air admitted from outside.

In this manner, dissipation through the roof is avoided, in that the outdoor and the indoor temperature (very close to the wall) will be the same.

Moreover, the state of over-pressure in which the inside of the building is kept prevents cold air from filtering in the lower part thereof; by reason of this provision, no inconveniences are caused by dust which would otherwise be raised.

The process according to the invention may be variously employed, for example in the building of glasshouses, stables, gymnasiums, swimming-pools, meeting-rooms, cinemas, theatres, etc. It can be applied both to roofs and walls, or to glass surfaces only; in the latter case, a suitable interspace is made by means of a porous translucent barrier.

The existing experimental plants were found to pay off in a very short time, by reason of the improvements in the environmental conditions and a considerable saving in energy.

Many changes and variations could then be provided by a person skilled in the art, although they should all fall within the ambit of the present invention.

I claim:

1. Process for diminished thermal dissipation air-conditioning of the open interior space of a building such as an industrial building, having side walls covered over by a roofing to form such open interior space and which open interior space defines an upper zone adjacent the roofing and a lower zone therebelow, so as to maintain the lower zone in generally existing heated condition to the extent of diminishing thermal dissipation of heat therefrom through the roofing, which comprises forcing outside air into the building through an inlet opening at the roofing and then laterally and tangentially in laminar flow in generally evenly spreading fashion along the adjacent inner surface of the roofing at a higher pressure relative to the existing pressure of the inside air in the open interior space and at a lower temperature relative to the existing temperature of said inside air and sufficiently to distribute the incoming outside air throughout the upper zone and to form an intervening insulating layer of stratified relatively overpressured outside air generally completely filling the upper zone and defining a thermally downwardly flowing generally horizontal uniformly distributed fluid barrier horizontally separating the inside air in the remainder of the open interior space in the lower zone therebelow from the roofing thereabove, for diminishing upward thermal flow of adjacent portions of the inside air from the lower zone to the roofing and otherwise resultant thermal dissipation of the existing heat content of the inside air through the roofing, and for permitting in turn generally uniformly distributed downward thermal flow of the outside air from the upper zone into the lower zone and into contact with the adjacent portions of the inside air to absorb heat content therefrom.

2. Process of claim 1 wherein portions of the outside air in the vicinity of the periphery of the adjacent inner surface of the roofing are also forced tangentially in laminar flow in generally evenly spreading fashion along the adjacent inner surface of the side walls sufficiently to form a corresponding intervening insulating layer of outside air defining a thermally downwardly flowing generally vertical uniformly distributed fluid barrier vertically separating the adjacent portions of the inside air in the lower zone from the side walls, so as correspondingly to maintain the lower zone in generally existing heated conditiion to the extend of diminishing thermal dissipation of heat therefrom through the side walls.

3. Process of operating a plant for carrying out diminished thermal dissipation air-conditioning of the open interior space of a building such as an industrial building, having side walls covered over by a roofing to form such open interior space and which open interior space defines an upper zone adjacent the roofing and a lower zone therebelow, using means including an inlet opening at the roofing, an air blower arranged thereat and a generally horizontally extending porous structural barrier separating the upper zone from the lower zone, so as to maintain the lower zone in generally existing heated condition to the extent of diminishing thermal dissipation of heat therefrom through the roofing, which comprises operating said means for forcing outside air into the building through the inlet opening at the roofing by the air blower and then laterally and tangentially in laminar flow between the roofing and the porous structural barrier in generally evenly spreading fashion along the adjacent inner surface of the roofing at a higher pressure relative to the existing pressure of the inside air in the open interior space below the porous structural barrier and at a lower temperature relative to the existing temperature of said inside air and sufficiently to form an intervening insulating layer of stratified relatively overpressured outside air generally completely filling the upper zone and providing a thermally downwardly flowing generally horizontal uniformly distributed fluid barrier for downward passage through the porous structural barrier for horizontally separating the inside air in the remainder of the open interior space in the lower zone therebelow from the roofing thereabove, for diminishing upward thermal flow of adjacent portions of the inside air from the lower zone to the roofing and otherwise resultant thermal dissipation of the existing heat content of the inside air through the roofing, and for permitting in turn generally uniformly distributed downward thermal flow of the outside air from the upper zone through the porous structural barrier into the lower zone and into contact with the adjacent portions of the inside air to absorb heat content therefrom.

4. Process of claim 3, wherein said means further include a generally vertically extending porous structural barrier spaced from the side walls and forming a continuation of the horizontally extending porous structural barrier and defining a vertical side wall flow area with the adjacent inner surface of the side walls, and said means are operated for also forcing by the air blower portions of the air in the vicinity of the periphery of the adjacent inner surface of the roofing tangentially in laminar flow in generally evenly spreading fashion along the adjacent inner surface of the side walls sufficiently to form a corresponding intervening insulating layer of outside air defining a thermally downwardly flowing generally vertical uniformly distributed fluid barrier vertically separating the adjacent portions of the inside air in the lower zone from the side walls, so as correspondingly to maintain the lower zone in generally existing heated condition to the extent of diminishing thermal dissipation of heat therefrom through the side walls.

5. Apparatus plant arrangement for carrying out a process for diminished thermal dissipation air-conditioning of the open interior space of a building such as an industrial building, having side walls covered over by a roofing to form such open interior space and which open interior space defines an upper zone adjacent the roofing and a lower zone therebelow, so as to maintain the lower zone in generally existing heated condition to the extent of diminishing thermal dissipation of heat therefrom through the roofing and correspondingly through the side walls, which comprises means including an inlet opening at the roofing, an air blower, a generally horizontally extending porous structural barrier separating the upper zone from the lower zone, and a generally vertically extending porous structural barrier spaced from the side walls and forming a continuation of the horizontally extending porous structural barrier and defining a vertical side wall flow area with the adjacent inner surface of the side walls, said means being arranged for forcing outside air into the building through the inlet opening at the roofing by the air blower and then laterally and tangentially in laminar flow between the roofing and the porous structural barrier in generally evenly spreading fashion along the adjacent inner surface of the roofing at a higher pressure relative to the existing pressure of the inside air in the open interior space below the porous structural barrier and at a lower temperature relative to the existing temperature of said inside air and sufficiently to form an intervening insulating layer of stratified relatively overpressured outside air generally completely filling the upper zone and providing a thermally downwardly flowing generally horizontal uniformly distributed fluid barrier for downward passage through the porous structural barrier for horizontally separating the inside air in the remainder of the open interior space in the lower zone therebelow from the roofing thereabove, for diminishing upward thermal flow of adjacent portions of the inside air from the lower zone to the roofing and otherwise resultant thermal dissipation of existing heat content of the inside air through the roofing, and for permitting in turn generally uniformly distributed downward thermal flow of the outside air from the upper zone through the porous structural barrier into the lower zone and into contact with the adjacent portions of the inside air to absorb heat content therefrom, and said means being also arranged for correspondingly forcing by the air blower portions of the air in the vicinity of the periphery of the adjacent inner surface of the roofing tangentially in laminar flow in generally evenly spreading fashion along the adjacent inner surface of the side walls sufficiently to form a corresponding intervening insulating layer of outside air defining a thermally downwardly flowing generally vertically uniformly distributed fluid barrier vertically separating the adjacent portions of the inside air in the lower zone from the side walls.

6. Arrangement according to claim 5, wherein at least one of the horizontally extending porous structural barrier and the vertically extending porous structural barrier is formed of translucent material.

7. Arrangement of claim 5, wherein at least one of the horizontally extending porous structural barrier and the vertically extending porous structural barrier is formed of inflatable tubular elements closely arranged in side by side relation.

* * * * *